US008755729B2

(12) United States Patent
Hagiwara et al.

(10) Patent No.: US 8,755,729 B2
(45) Date of Patent: Jun. 17, 2014

(54) GLOSSINESS PROCESSING APPARATUS AND IMAGE FORMING APPARATUS

(75) Inventors: Emi Hagiwara, Yokohama (JP); Yasunori Chigono, Atsugi (JP); Makoto Fukatsu, Suntou-gun (JP); Shintaro Ishida, Toda (JP); Shunichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 13/326,733

(22) Filed: Dec. 15, 2011

(65) Prior Publication Data

US 2012/0155940 A1 Jun. 21, 2012

(30) Foreign Application Priority Data

Dec. 16, 2010 (JP) ..... 2010-280769

(51) Int. Cl.
*G03G 15/20* (2006.01)

(52) U.S. Cl.
USPC ..... 399/341; 399/337

(58) Field of Classification Search
USPC ..... 399/122, 320, 335, 338, 341; 430/45.53, 124.13, 124.37, 126.2; 427/494
See application file for complete search history.

(56) References Cited

U.S. PATENT DOCUMENTS

| | | | | |
|---|---|---|---|---|
| 5,223,901 | A * | 6/1993 | Endo et al. | 399/334 |
| 5,402,220 | A * | 3/1995 | Tanaka et al. | 399/68 |
| 7,200,354 | B2 | 4/2007 | Nakamoto et al. | |
| 7,206,541 | B2 | 4/2007 | Fukita et al. | |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,783,242 | B2 | 8/2010 | Chigono et al. | |
| 7,844,208 | B2 | 11/2010 | Hayashi et al. | |
| 2007/0147917 | A1 | 6/2007 | Chigono et al. | |
| 2010/0303525 | A1 * | 12/2010 | Mitsuoka et al. | 399/329 |
| 2010/0303527 | A1 * | 12/2010 | Mitsuoka | 399/329 |
| 2010/0316403 | A1 * | 12/2010 | Furuya et al. | 399/67 |
| 2011/0103851 | A1 * | 5/2011 | Hamby et al. | 399/328 |
| 2011/0135352 | A1 | 6/2011 | Takada | |
| 2012/0003346 | A1 | 1/2012 | Chigono et al. | |
| 2012/0251153 | A1 * | 10/2012 | Takada | 399/68 |

FOREIGN PATENT DOCUMENTS

| | | | |
|---|---|---|---|
| JP | 10-315515 | A | 12/1998 |
| JP | 2000-301749 | A | 10/2000 |
| JP | 2007-086747 | A | 4/2007 |

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

A glossiness processing apparatus for glossiness treatment includes a first glossiness treatment unit; a second glossiness treatment unit provided downstream of the first glossiness treatment unit with respect to a feeding direction of a sheet; wherein each of the units including a film movable having a surface in contact with an image surface of the sheet while moving; a heating member contacted to another surface of the film, the heating member including a plurality of heat generating elements arranged along a direction substantially perpendicular to a moving direction of the film; a pressing member cooperating with the heating member to form a nip, with the film therebetween, for nipping and feeding the sheet; wherein positions of the heat generating elements are offset relative to positions of the heat generating elements of the first glossiness treatment unit.

15 Claims, 6 Drawing Sheets

GLOSSINESS PROCESSING APPARATUS AND IMAGE FORMING APPARATUS

FIELD OF THE INVENTION AND RELATED ART

The present invention relates to a glossiness processing apparatus or thermal surface finishing apparatus (device) for changing in surface texture (glossy, matted, etc.) an image formed on recording medium. It relates also an image forming apparatus having a thermal surface finishing unit for changing in surface texture an image on recording medium to change the image in gloss.

Generally, the recording medium of a print, and the substance of which an image was formed on the recording medium of the print, are different in gloss. Thus, the gloss of a print is affected by the print ratio of the print. Thus, it has been proposed to process a print after the completion of the print, in order to make the print uniform in gloss. For example, Japanese Laid-open Patent Applications 2007-086747, H10-315515, and 2000-301749 disclose technologies for increasing in gloss the image bearing surface of a sheet of recording medium.

The above-mentioned conventional technologies have the following problems. That is, in order to improve in gloss the image bearing surface of recording medium, it is necessary for the surface texture of the sheet of film to be accurately transferred onto the image bearing surface of recording medium. In order for the surface texture of a sheet of film to be accurately transferred onto the surface of a sheet of recording medium, the sheet of film needs to be placed in contact with the surface of a sheet of recording medium with the presence of no gap. However, the surface of a sheet of recording medium is uneven because of the difference in the size of among numerous fibers or the like of which a sheet of recording medium is formed. Therefore, it is rather difficult to make a sheet of film to contact the surface of a sheet of recording medium with the presence of absolutely no space between the sheet of film and the surface of the sheet of recording medium. In other words, it is virtually impossible to place a sheet of film in contact with absolutely no space between the sheet of film and a sheet of recording medium. Thus, as a print is superficially heated to be changed in gloss (surface texture), the surface of the print becomes microscopically nonuniform in gloss.

In a case where a thermal head is used as the heating means for transferring the surface texture of a sheet of film onto the surface of a print (combination of sheet of recording medium and toner image thereon), it sometimes occurs that the surface of the print becomes imperfect in gloss: gloss imperfections occur across the surface of the print. These gloss imperfections are in a linear alignment, and the severity of the imperfection seem to be correspondent to the number of heat generating elements of the thermal head. More specifically, no heat is generated in the gap between any adjacent two heat generating elements of the thermal head. Thus, the portions of a sheet of film, which come into contact with these gap portions of the thermal head, fail to transfer their surface texture onto the surface of the print. This is why the above described gloss imperfections occur in a linear pattern.

SUMMARY OF THE INVENTION

Thus, the primary object of the present invention is to provide a glossiness processing apparatus, that is, a thermal finishing apparatus capable of changing in gloss the image bearing surface of a print (combination of sheet of recording medium and image thereon), without making the image bearing surface of the print imperfect, for example, nonuniform, in gloss, and an image forming apparatus having a gloss changing apparatus capable of changing in gloss the image bearing surface of a print (combination of sheet of recording medium and image thereon), without making the image bearing surface of the print nonuniform imperfect, for example, nonuniform, in gloss.

According to an aspect of the present invention, there is provided a glossiness processing apparatus for glossiness treatment of an image surface of an image formed on a recording material, said glossiness processing apparatus comprising a first glossiness treatment unit; a second glossiness treatment unit provided downstream of said first glossiness treatment unit with respect to a feeding direction of the recording material; wherein each of said first and second glossiness treatment units including, a film movable having a surface in contact with an image surface of the recording material while moving; a heating member contacted to another surface of said film, said heating member including a plurality of heat generating elements arranged along a direction substantially perpendicular to a moving direction of said film; a pressing member cooperating with said heating member to form a nip, with said film therebetween, for nipping and feeding the recording material; wherein positions of said heat generating elements are offset relative to positions of said heat generating elements of said first glossiness treatment unit.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are concretely described in detail with reference to the appended drawings. The following embodiments of the present invention are not intended to limit the present invention in scope in terms of the measurements, materials, and shapes of the structural components of a glossiness processing apparatus, that is, a thermal finishing apparatus (device) and an image forming apparatus, and the positional relationship among the structural components, unless specifically noted.

Embodiment 1

1-1: General Structure of Image Forming Apparatus

Figure 1:
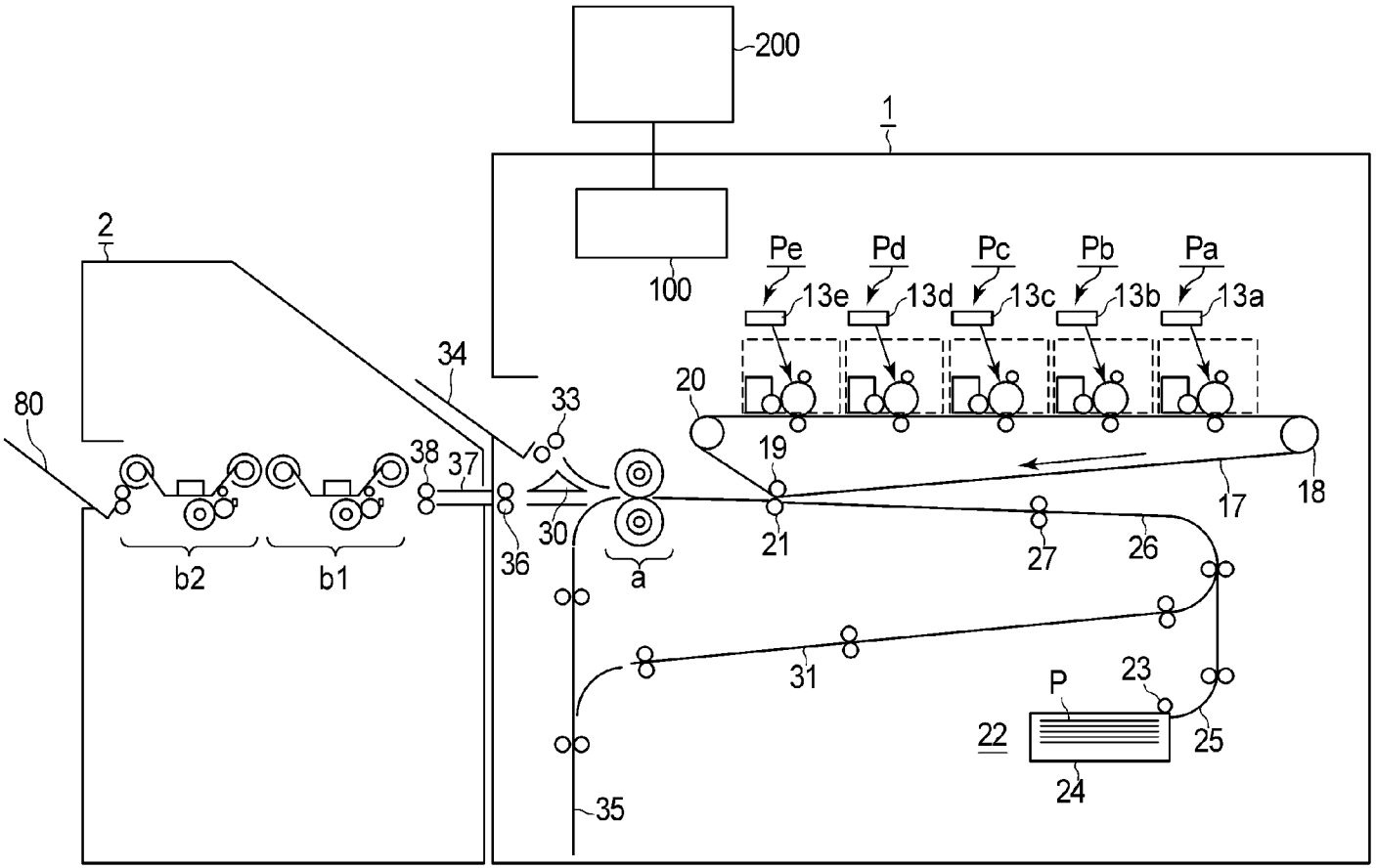
FIG. 1 is a schematic sectional view of the image forming apparatus in the first preferred embodiment of the present invention, and shows the general structure of the apparatus.
Figure 2:
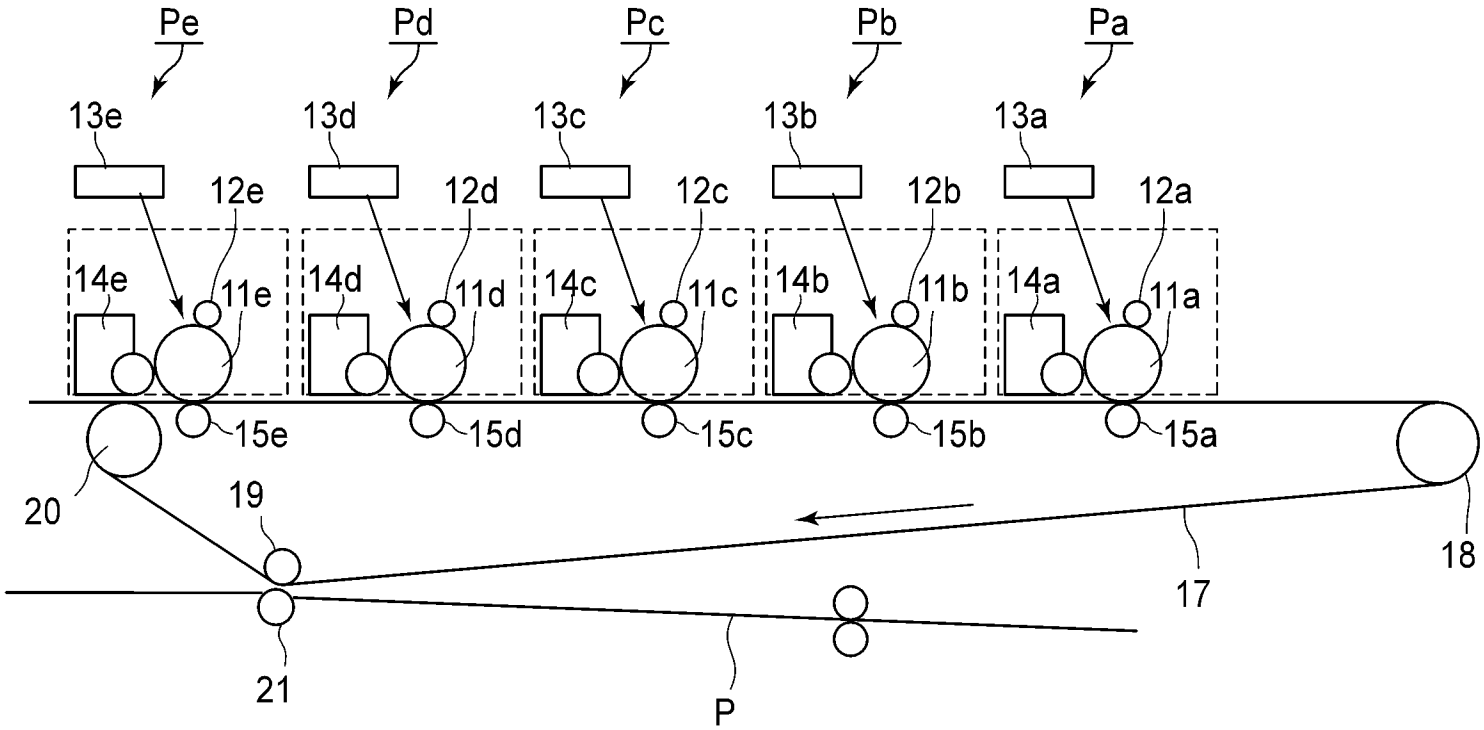
FIG. 2 is a schematic sectional view of the image forming portion of the image forming apparatus in the first embodiment of the present invention, and shows the general structure of the image forming portion.

First, referring to FIGS. 1 and 2, the general structure of the image forming apparatus in this embodiment is described. As illustrated in FIG. 1, the image forming apparatus is a combination of a main assembly 1 and a thermal finishing device 2. The main assembly 1 has an image forming portion. The thermal finishing device 2 is one of the optional devices for the image forming apparatus, and is in connection to the print output side of the main assembly 1. Thus, as a print is outputted from the apparatus main assembly 1, its image bearing surface can be changed in gloss by the thermal finishing device 2 (which hereafter may be referred to as surface finishing device).

The apparatus main assembly 1 is an electrophotographic full-color image forming apparatus based on four primary colors (color image forming apparatus of so-called tandem type). It has four image forming stations Pa-Pd which correspond one for one to the four monochromatic images of four primary colors (yellow, magenta, cyan and black toners), one for one. The apparatus main assembly 1 is also provided with an image forming station Pe in addition to the four image forming stations Pa-Pd. The image forming station Pe is for forming an image of transparent toner, that is, toner which does not contain a coloring agent, being therefore invisible to human eye. Thus, the main assembly 1 can form a multicolor toner image (inclusive of monochromatic image) by layering four monochromatic toner images, different in color, and then, place a layer of transparent toner on a desired area or desired areas of the multicolor toner image. For example, it can adhere transparent toner to an area or areas of a print (combination of recording medium and toner image thereon), which are low in print ratio, and process the print with its thermal finishing device (which is described later) to increase in gloss the area or areas of the print to which it adhered transparent toner.

The apparatus main assembly 1 is in connection to an external host apparatus 200 such as a color image reading apparatus, a personal computer, and the like. It is from the host apparatus 200 that various information signals such as those of the image formation data are inputted into the control section 100 (CPU) of the apparatus main assembly 1, which makes the apparatus main assembly 1 to carry out an image formation sequence in response to the various information signals inputted from the host apparatus 200.

FIG. 2 is an enlarged schematic sectional view of the image forming portions of the image forming apparatus of the apparatus main assembly 1. It shows the general structure of the image forming portions. The image formation sequence carried out by the image forming portions in this embodiment to form an image on a sheet P of recording medium is as follows: The photosensitive drums 11 (11*a*, 11*b*, 11*c*, 11*d* and 11*e*) are rotated in the counterclockwise direction of FIG. 2 at a preset speed by an unsown driving means. As they are rotated, the peripheral surfaces of the photosensitive drums 11 (11*a*, 11*b*, 11*c*, 11*d* and 11*e*) are uniformly charged to a preset potential level by the primary charging devices 12 (12*a*, 12*b*, 12*c*, 12*d* and 12*e*), respectively. Then, the charged peripheral surface of each photosensitive drum 11 is scanned by (exposed to) the beam of laser light projected from the corresponding scanner 13 (13*a*, 13*b*, 13*c*, 13*d* or 13*e*). Consequently, an electrostatic latent image is effected on the peripheral surface of each photosensitive drum 11.

Thereafter, the latent images on the photosensitive drums 11 are provided with toner by the developing devices 14 (14*a*-14*e*), one for one, whereby they are developed into visible images (images formed of toner). Then, the toner images on the photosensitive drums 11 are sequentially transferred in layers from the photosensitive drums 11 (11*a*, 11*b*, 11*c*, 11*d* and 11*e*) onto an intermediary transfer belt 17, in the nips between the photosensitive drums 11 and corresponding primary transfer rollers 15 (15*a*, 15*b*, 15*c*, 15*d* and 15*e*), which are on the opposite side of the intermediary transfer belt 17 from the photosensitive drums 11 (11*a*-11*e*), respectively. Consequently, a full-color image is effected on the intermediary transfer belt 17.

The toner particles which were not transferred (primary transfer) onto the intermediary transfer belt 17, that is, the toner particles remaining on the peripheral surface of the photosensitive drum 11, are removed by an unshown cleaner, or through the development/cleaning process. The order in which the yellow, magenta, cyan, black, and transparent toner image forming stations are arranged is optional. That is, it may be altered according to image forming apparatus design.

The intermediary transfer belt 17 is suspended and kept stretched by rollers 18, 19 and 20 so that it can be circularly moved. After the transfer of the toner images onto the intermediary transfer belt 17, the toner images are moved to the nip (second transfer station) between a secondary transfer roller 21, and the roller 19 which opposes the second transfer roller 21 across the intermediary transfer belt 17, and are moved through the nip by the movement of the intermediary transfer belt 17. As the toner images are moved through the nip, they are transferred (secondary transfer) from the intermediary transfer belt 17 onto a sheet P of recording medium. The toner particles which were not transferred (secondary transfer) onto the sheet P, that is, the toner particles remaining on the intermediary transfer belt 17 after the secondary transfer, are removed by an unshown cleaning device.

The apparatus main assembly 1 is provided with a recording sheet feeding station 22, which is in the bottom portion of the apparatus main assembly 1, and in which a recording sheet feeder cassette 24 is removably mountable. The cassette 24 is capable of holding in layers a substantial number of sheets P of recording medium. The sheet P in the cassette 24 is a sheet of coated paper which is 170 g/m$^2$, for example, in basis weight. As an image formation start signal is inputted into the apparatus main assembly 1, the sheets P of recording medium in the sheet feeder cassette 24 begin to be fed one by one into the apparatus main assembly 1. Then, each sheet P of recording medium is conveyed through sheet conveyance passages 25 and 26 to the second transfer station by a pair of registration rollers 27. Further, the apparatus main assembly 1 has two recording medium conveyance passages for two-sided image formation. That is, it has a sheet passage 35 for turning over a sheet P of recording medium after the fixation of the toner image on the sheet P by a fixing device a, and a sheet passage 31 for conveying the sheet P to the second transfer station for the second time after the sheet P is turned over.

After the transfer of a full-color toner image onto the sheet P of recording medium, the sheet P is separated from the intermediary transfer belt 17 with the use of the curvature of the intermediary transfer belt 17, and then, is conveyed to the fixing device a, in which the sheet P and the full-color toner image thereon are subjected to heat and pressure by the fixing device a. Thus, the full-color toner image becomes fixed to the surface of the sheet P. The fixing device a is 110 mm/s in process speed and 175° C. in fixation temperature. It has been adjusted so that after fixation, the image on a sheet P of recording medium will be 10% in 60° gloss. Incidentally, the fixing device a in this embodiment is a fixing device of the heat roller type. However, the fixing devices to which the present invention is applicable are not limited to those of the heat roller type. That is, the present invention is applicable to a fixing device of the heating film type, that is, a fixing device which employs a sheet of flexible film as its component which comes directly in contact with a sheet P of recording medium and the toner image thereon.

When the image forming apparatus is not in the print surface finishing mode, the sheet P is discharged from the apparatus main assembly 1 onto a first delivery tray 34 by a pair of the first discharge rollers 33 after the fixation of the toner image to the sheet P. On the other hand, when the image forming apparatus is in the print surface finishing mode, the sheet P is sent into the print surface finishing device 2 by a pair of second discharge rollers 36 through a sheet passage 29, which is the direct sheet passage to the thermal finishing device 2. Whether the sheet P is discharged onto the delivery tray 34, or conveyed to the print surface finishing device 2, is controlled by a flapper 30 which is under the control of the control section 100.

1-2: Toner

Next, the toner used by the image forming apparatus in this embodiment is described. The toner is in the form of a microscopic particle, and contains at least bonding resin, coloring agent, and wax. The bonding resin is one of the resins which have been widely used as bonding resin for toner. It does not need to be particular, but it is desired to be hybrid resin having a polyester unit and vinyl polymer unit, polyester resin, vinyl polymer, or a mixture of preceding resins.

The bonding resin is in a range of 4,000-10,000 in peak molecular weight (Mp) in the molecular weight distribution obtained with the use of Gel Permeation Chromatography (GPC). The ratio (Mw/Mn) of its weight average molecular weight (Mw) relative to its numerical average molecular weight (Md) is desired to be no less than 300, preferably, 500. It may be adjusted in molecular weight distribution by adjusting the condition under which the bonding resin is polymerized, mixing bonding resin, which is proper in average molecular weight, into the bonding resin, or the like method.

As a coloring agent contained in the toner particles, known pigments and dyes can be used. For example, as a black coloring agent, it is possible to use carbon black, acetylene black, lamp black, graphite, iron black, aniline black, cyanine black, and the like.

Examples of a colored pigment for magenta may include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. pigment violet 19; C.I. bat red 1, 2, 10, 13, 15, 23, 29, 35 and the like.

Examples of a dye for magenta may include oil-soluble dyes of C.I. solvent red 1, 3, 8, 23, 24, 25, 27, 30, 49, 81, 82, 83, 84, 100, 109, 121; C.I. D spar thread 9; C.I. solvent violet 8, 13, 14, 21, 27; C.I. disperse violet 1; and the like, and basic dyes of C.I. basic red 1, 2, 9, 12, 13, 14, 15, 17, 18, 22, 23, 24, 27, 29, 32, 34, 35, 36, 37, 38, 39, 40; C.I. basic violet 1, 3, 7, 10, 14, 15, 21, 25, 26, 27, 28, and the like.

Examples of a colored pigment for cyan may include C.I. pigment blue 2, 3, 15:1, 15:2, 15:3, 16, 17; C.I. acid blue 6; C.I. acid blue 45; and a copper phthalocyanine pigment in which 1-5 phthalimidomethyl groups are replaced at a phthalocyanine skeleton, and the like.

Examples of a colored pigment for yellow may include C.I. pigment yellow 1, 2, 3, 4, 5, 6, 7, 10, 11, 12, 13, 14, 15, 16, 17, 23, 65, 73, 74, 83, 93, 97, 155, 180; C.I. bat yellow 1, 3, 20, and the like.

An amount of use of the coloring agent may preferably be 3-20 parts by weight, more preferably 6-10 parts by weight, per 100 parts by weight of the binder resin from a balance of reproducibility of an intermediate color and coloring power. As the wax contained in the toner particles, known waxes can be used. Examples of such waxes may include aliphatic hydrocarbon wax such as polyolefin wax, low-molecular weight polyethylene, low-molecular weight polypropylene, microcrystallin wax, Fischer-Tropsch wax and paraffin wax such as oxide of the aliphatic hydrocarbon wax such as oxidized polyethylene wax; their block copolymers; waxes principally containing fatty acid esters such as carnauba wax and montanic acid ester wax; and fatty acid esters a part or all of which is deacidified, such as deacidified carnauba wax, and the like.

Further, examples of the waxes may include saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol, fatty amides such as linolic acid amide, oleic acid amide and lauric acid amide, saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N, N'-dioleyl adipic acid amide, and N, N'-dioleyl sebacic acid amide; aromatic bisamides such as m-xylenebisstearic acid amide and N, N'-distearylisophthalic acid amide; aliphatic metal salts (so-called a metal soap) such as calcium stearate, calcium laurate, zinc stearate and magnesium stearate; waxes obtained by grafting vinyl monomer such as styrene or acrylic acid onto aliphatic hydrocarbon wax; partially esterified compound of a fatty acid such as behenic acid monoglyceride and polyhydric alcohol; and methyl ester compounds having a hydroxyl group obtained by hydrogenation or the like of vegetable fat and oil.

The wax is desired to be in a range of 0.1-20 parts, preferably, 0.5-10, in weight per 100 parts of bonding resin. As for the method for mixing the wax into the bonding resin, the bonding resin is dissolved in solvent, and then, the bonding resin solution is increased in temperature. Then, the wax is mixed into the bonding resin solution while the solution is stirred. Another method for producing toner which contains the wax is to mix the wax into the mixture of the other toner materials when kneading the mixture.

It is acceptable to add an external additive or additives to toner in order to control the toner in fluidity and developmental performance. As the external additive, various inorganic oxides, such as silica, alumina, titanium oxide, cerium oxide, which are in the form of a microscopic particle, and vinyl polymer and zinc stearate, which are in the form of a microscopic particle, can be used. The inorganic oxides may be made hydrophobic. The amount by which the external additive is to be added to the toner is desired to be in a range of 0.02-5.0 in wt. %.

The transparent toner to be used by the image forming apparatus in this embodiment is such toner that is invisible to human eyes after fixation. It is made with the use of the same method as the above-described toner making method, except that no coloring agent is included as the materials for the toner. The transparent toner is laid on the combination of the color toner layers. Thus, it has to be virtually perfectly transparent after its fixation. The measured maximum density of the transparent toner that is, Amax, was 0.015 per unit thickness. The transparent toner is desired to be in a range of 0.001-0.1 in Amax.

1-3: General Structure of Thermal Finishing Device

Figure 3:
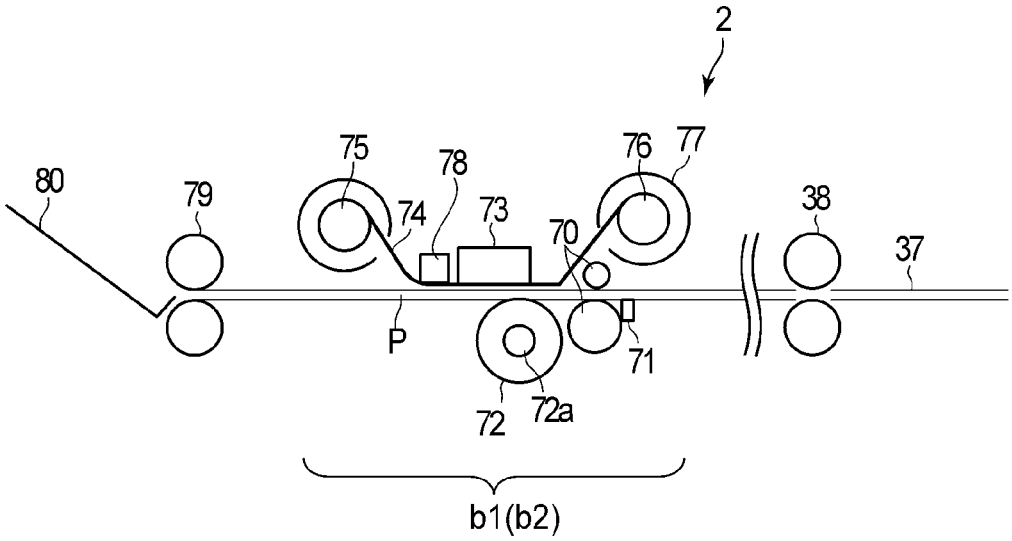
FIG. 3 is a schematic sectional view of the glossiness processing apparatus, that is, the thermal finishing apparatus in the first embodiment of the present invention, and shows the general structure of the apparatus.

Next, referring to FIG. 3, the thermal finishing device 2 in this embodiment is described. The thermal finishing device 2 in this embodiment has two surface finishing units (first and second surface finishing units b1 and b2, respectively). Since the two surface finishing units b1 and b2 are the same in structure, only the surface finishing unit b1 is described.

The thermal finishing device 2 is a device capable of partially changing in gloss the surface of a print (combination of sheet P of recording medium, and image thereon) by subjecting the print to a heating-cooling-separating process. The thermal finishing device 2 in this embodiment is capable of processing the image bearing surface of a print twice to change the surface in gloss. More concretely, the thermal finishing device 2 is provided with two surface finishing units, which are sequentially positioned in the recording medium conveyance direction, being thereby enabled to process twice the image bearing surface of a print to change the surface in gloss. Incidentally, the number of the surface finishing units with which the surface finishing unit 2 is provided does not need to be limited to two. That is, the same effects as those obtainable by the thermal finishing device 2 in this embodiment can be obtainable by a thermal finishing device of another type as long as it is provided with two or more surface finishing units.

Designated by a referential code 38 in FIG. 3 is a pair of recording medium conveyance rollers, which feed a print into the thermal finishing unit b1 after the print is conveyed from the image formation unit 1 to the rollers 38 through the sheet conveyance passage 37. The speed at which the pair of rollers 38 conveys the sheet P is 50 mm/s. Designated by a referential code 70 is a pair of rollers, which make it possible for the print (sheet P) to be conveyed into the thermal finishing unit b1. The pair of rollers 70 conveys the sheet P by pinching the sheet P with the pair of rollers 38. Further, designated by a referential code 71 is a sensor for detecting the leading and trailing edges of the print (sheet P) while the print (sheet P) is conveyed to the surface finishing unit b1.

Designated by a referential code 72 is a platen roller (pressure applying rotational member), which is on the opposite side of the sheet conveyance passage from the heating nip. Designated by a referential code 73 is a thermal head (heating member), the heating surface of which can be partially or entirely increased in temperature based on the information based on which recording was made on the sheet P. More specifically, the heating surface of the thermal head 73 has a large number of heat generating elements, which are aligned in the direction perpendicular to the recording medium conveyance direction. The number of the heat generating elements corresponds to the number of pixels in the direction perpendicular to the recording medium conveyance direction.

Designated by a referential code 74 is a transfer film, which the thermal head 73 contacts. The thermal finishing unit b1 is structured so that the transfer film 74 can be moved in the direction perpendicular to the alignment direction of the multiple heat generating elements of the thermal head 73 while remaining kept in contact with the multiple heat generating elements of the thermal head 73, and also, so that as the platen roller 72 is pressed against the thermal head 73 with the presence of the transfer film 74 between the platen roller 72 and thermal head 73, a nip is formed between the platen roller 72 and transfer film 75. Further, the surface finishing unit b1 is structured so that as the platen roller 72 is rotated, the transfer film 74 is moved by the rotation of the platen roller 72 while remaining pinched between the platen roller 72 and transfer film 74. While the print (sheet P) is conveyed through the nip (heating nip), the image bearing surface of the print (sheet P) is processed (heated), being thereby changed in gloss.

Designated by a referential code 75 is a shaft (take-up shaft) for taking up the transfer film 74 as the transfer film 74 is moved downstream through the heating nip of the surface finishing unit b1, and designated by a referential code 76 is a shaft (supply shaft) for supplying the heating nip with the transfer film 74. Designated by a referential code 77 is a transfer film cassette in which a roll of transfer film 74 is held. Designated by a referential code 78 is a separating member for separating the transfer film 74 from the print (sheet P) after the transfer film 74 is pressed upon the print (sheet P) by the thermal head 73. Designated by a referential code 79 is a pair of discharge rollers for discharging the print (sheet P) from the thermal finishing device 2. Designated by a referential code 80 is a delivery tray. Hereafter, the essential structural components of the above described surface finishing unit b1 are described in more detail.

(Thermal Head)

Figure 4:
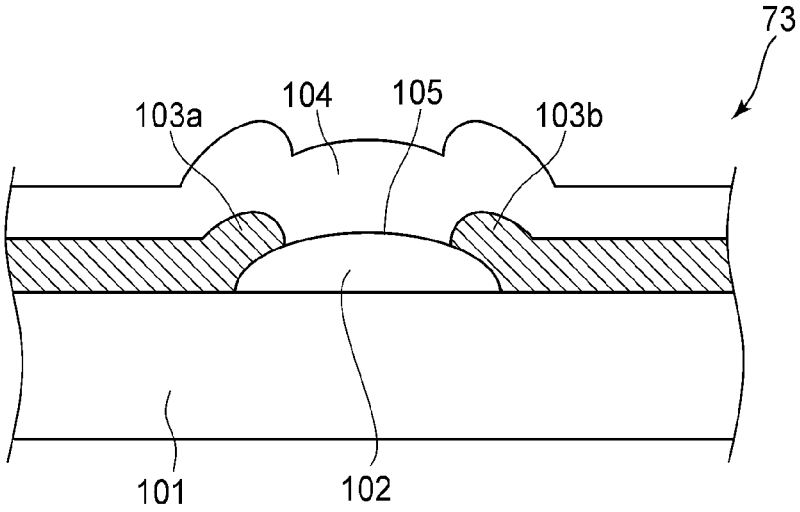
FIG. 4 is a schematic sectional view of one of the heat generation elements of the thermal head in the first embodiment of the present invention, and shows the general structure of the element.

The thermal head 73 is for heating the image bearing surface of a print (sheet P and image thereon) through the transfer film 74 while the print (sheet P) is conveyed through the aforementioned nip. The thermal finishing unit b1 is structured so that as the print is introduced into the nip of the unit b1, the image bearing surface of the print comes into contact with the transfer film 74. Referring to FIG. 4 which shows the general structure of one of the heat generating elements of the thermal head 73, the thermal head 73 is made up of a substrate 101, a glaze 102 (insulation layer), common electrodes 103*a*, lead electrodes 103*b*, and heat generating elements 105. The substrate 101 is made of alumina or the like. The glaze 102, common electrodes 103*a*, lead electrodes 103*b*, and heat generating elements 105 are formed by printing. Further, the thermal head 73 has a protective layer 104 (overcoat layer) which covers the top surface of each electrode and each heat generating element.

The thermal head 73 is provided with additional structural members such a driving circuit and a heat radiation plate. The driving circuit is for selectively supplying multiple heat generating elements (aligned perpendicular to recording medium conveyance direction) with electrical power to make them generate heat. The heat radiation plate is for radiating an excessive amount of heat after a print (sheet P) is given heat.

It is in the form of a pulse that electric power is supplied to the thermal head 73. The methods for controlling the electric power supply to the thermal head 73 can be classified into two groups, that is, a pulse width control group and a pulse frequency control group. The pulse width control group controls the electric power supply by changing the power in the pulse width while keeping the power constant in the pulse frequency, whereas the pulse frequency control group controls the power supply by changing the power in pulse frequency while keeping the power constant in pulse width. The former makes it possible to provide a thermal finishing device capable of highly precisely controlling a print in gradation and density, but it makes complicated the portion of the device, which is for controlling the print in halftone. On the other hand, the latter adjusts inputs in gradation by preparing preset pulse sequences and reapportioning the inputted information about gradation. Therefore, it is less in the amount of load upon the halftone control portion. However, in order to highly precisely control a thermal finishing device in density, a substantially greater number of pulses are necessary than the actual number of gradation levels. In this embodiment, therefore, the former is employed to control the thermal head 73 in the intermediary heat range in which the thermal head 74 generates heat.

The density of the heat generating elements 105 of the thermal head 73, that is, the number of the heat generating elements in terms of the direction perpendicular to the recording medium conveyance is 150 dpi. Further, the recording density is 150 dpi, and the driving voltage is 300 V. The average resistance value of the heat generating elements is 5,000Ω. However, this embodiment is not intended to limit the present invention in terms of the number of the heat generating elements 105, heat generating element density, etc.

Figure 5:
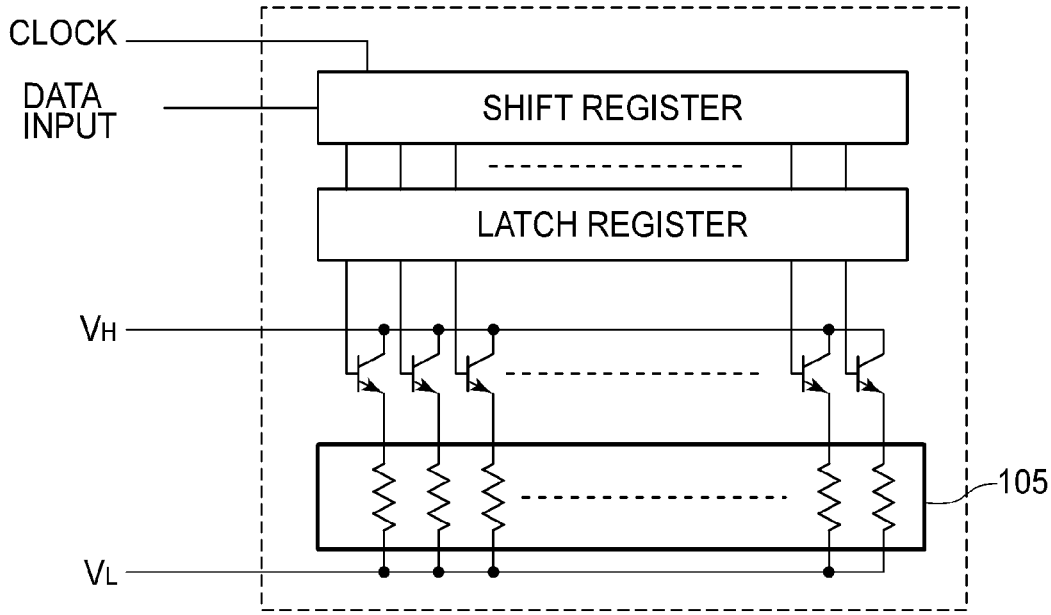
FIG. 5 is a schematic diagram of the thermal head driving circuit in the first embodiment of the present invention.

FIG. 5 shows the general structure of the circuit for driving the thermal head 73. There is a line of heat generating elements 105 on the above-described substrate 101. Present also on the substrate 101 are electrodes VH and VL which are on one side of the line of the heat generating element 105 and the other side, respectively. The circuit has also a driver IC which includes a group of registers for transferring and/or retaining the data for each line of the heat generating elements. The driver IC is on the substrate 101 (made of alumina), or another substrate.

(Platen Roller)

The platen roller 72 is a rubber roller. It is made up of a shaft 72*a*, and a surface layer formed of hard rubber, for example, silicon rubber or the like, which is relatively high in friction coefficient. It is supported by the frame of the thermal finishing unit b1, by its shaft 72*a*. The thermal finishing unit b1 is structured so that as the platen roller 72 is driven by an unshown driving power source, the transfer film 74 is moved in the same direction as the print (sheet P).

(Transfer Film)

The transfer film 74 is in the form of a roll, and is fitted around the film supply shaft 76. The thermal finishing unit b1 is structured so that as the transfer film 74 is taken up, as necessary, by the film take-up shaft 75, a fresh portion of the transfer film 74 is fed into the surface finishing station, which includes the thermal head 73. Since the transfer film 74 has to be capable of partially and highly efficiently heating a print (sheet P), it is formed of thin and flexible material. That is, according to the earnest studies made by the inventors of the present invention, the transfer film 74 is desired to be no less than 4 μm, and no more than 20 μm, in thickness. As long as the thickness of the transfer film 74 is in this range of 4 μm-20 μm, the transfer film 74 is flexible and durable, and can transfer its surface texture onto the surface of a print (sheet P) regardless of whether or not the surface of the print (sheet P) is microscopically rough. The film used as the material for the transfer film 74 in this embodiment is polyimide film which is 12 μm in thickness and is resistant to a temperature level higher than 200° C. However, this embodiment is not intended to limit the present invention in terms of the material for the transfer film 74. That is, the present invention is applicable to a thermal finishing device, the transfer film of which is made of ordinary resin film, such as PET film, instead of polyimide film.

The transfer film 74 is for transferring its surface texture onto the surface of a print. Thus, highly glossy film, that is, film whose surface is flawlessly flat, is used as the material for the transfer film 74 of the thermal finishing unit b1. The unit b1 can process the image bearing surface of a print (sheet P) so that the surface appears as glossy as the surface of an ordinary photograph. On the other hand, if film whose surface has been matted by sandblasting or the like method, or film whose surface is given a surface texture having a special pattern, is used as the material for the transfer film 74 of the thermal finishing unit b1, the unit b1 can transfer in reverse the superficial pattern of the transfer film 74 onto the image bearing surface of the print. For example, film whose superficial texture is like that of silk cloth, Japanese paper, or embossed paper can be used as the material for the transfer film 74 to give the image bearing surface of the print the appearance of silk cloth, Japanese paper, or embossed paper, respectively. Further, film having a geometrical superficial texture or a lattice-like superficial texture can be used as the material for the transfer film 74 to give the image bearing surface of a print a geometrical or lattice-like appearance. Further, it is possible to provide the transfer film 74 with a geometric surface structure which is in the order of 1 μm or less in dimension, in order to transfer a holographic texture (holographic color) onto the print (recording sheet P and toner image thereon). That is, the thermal finishing unit b1 can be fitted with various transfer films 74 different in superficial texture and pattern to give various appearances to the image bearing surface of a print as necessary.

(Separating Member)

The separating member 78 plays two roles, that is, a role of cooling the transfer film 74 and a role of separating the transfer film 74 from the sheet P of recording medium, with the use of film curvature. It is made of such a metal as SUS. The portions of the surface of the separating member 78, which come into contact with the transfer film 74, are provided with a curvature (separation curvature) which is equivalent to the curvature of a circle which is 1 mm in radius. It is made small enough in separation curvature to ensure that it can separate the transfer film 74 from a print (recording sheet P and toner image thereon).

1-4: Operation of Thermal Finishing Device

The thermal finishing device 2 has the two surface finishing units b1 and b2, which sequentially aligned in the recording medium conveyance direction. In a surface finishing operation, first, the image bearing surface of a print is heated (first processing) by the surface finishing unit b1, which is the surface finishing upstream unit b1 in terms of the recording medium conveyance direction (FIG. 1).

More concretely, in a surface finishing operation carried out by the thermal finishing device 2, as a print (sheet P) begins to be conveyed through the thermal finishing device 2, the leading edge of a print (sheet P) is detected by the sensor 71 (FIG. 3) for detecting the leading and trailing edges of the print (sheet P). As soon as the leading edge of the print is detected by the sensor 71, the platen roller 72 is pressed onto the transfer film 74 from the opposite side of the transfer film 74 from the thermal head 73. Then, the heat generating elements 105 of the thermal head 73 are selectively made to generate heat with such timing that is in coordination with the inputted image information. Thus, as the print (sheet P) is conveyed through the heating nip while remaining pinched between the transfer film 74 and platen roller 72, the image bearing surface of the print is changed in surface texture, being thereby changed in gloss. More specifically, the thermal finishing unit b1 is controlled so that the electric power to be supplied to each heat generating element is changed in pulse width, or pulse frequence. The transfer is made line by line. That is, as the surface texture of the portion of the transfer film 74, which corresponds in position to the line of heat generating elements, is transferred onto the image bearing surface of the print (sheet P), the platen roller 42 is rotated by an angle which corresponds to the line of the heat generating elements to move the transfer film 74 and print (sheet P) together. After the print (sheet P) comes out of the heating nip, the platen roller 72 is moved away from the transfer film 74.

After the print (sheet P) is changed in surface texture (gloss), the transfer film 74 is separated from the print (sheet P) by the curvature of the transfer film 74. Then, the print is conveyed to the surface finishing unit b2, that is, the downstream surface finishing unit for finishing (second processing) the image bearing surface of the print for the second time. Basically, the surface finishing unit b2, that is, the downstream surface finishing unit, is the same in structure as the upstream surface finishing unit b1, or the surface finishing unit which process the image bearing surface of a print for the first time, except for the position of the heat generating elements 105 relative to the transfer film 74. More specifically, each of the heat generating elements of the surface finishing unit b2 is displaced in the heat generating element alignment direction, relative to the corresponding heat generating element of the surface finishing unit b1, by an amount distance equal to the amount of the heat generating element interval.

To describe in more detail the "amount of the displacement of the heat generating element" mentioned above, the number of heat generating elements 105 of the thermal head 73 in this embodiment is 150 dpi. Thus, in terms of the heat generating element alignment direction, the displacement of a given heat generating element of the thermal head 73 of the second surface finishing unit b2 relative to the corresponding heat generating element of the thermal head 73 of the first surface finishing unit b1 is 85 μm, which is equal to the heat generating element interval of both surface finishing units b1 and b2. As for the means for the displacement, the thermal finishing device 2 may be structured so that the thermal head 73 of the surface finishing unit b2 is displaced relative to the thermal head 73 of the surface finishing unit b1 in terms of the heat generating element alignment direction, or so that the thermal head 73 of the surface finishing unit b1 or b2 is structured so that as the thermal finishing device 2 is assembled, a given heat generating element of the thermal head 73 of one of the surface finishing units b is displaced relative to the counterpart of the thermal head 73 of the other unit b. After the processing of the image bearing surface of the print (sheet P) by the surface finishing unit b2, or the downstream surface finishing unit, which is structured as described above, the print (sheet P) is discharged onto a delivery tray 80 from the thermal finishing device 2.

As described above, the thermal finishing device 2 in this embodiment is provided with two surface finishing units b1 and b2, and is structured so that a given heat generating element of one of the two surface finishing units b1 and b2 is displaced in the direction of the alignment direction by an amount equal to the amount of the heat element interval. Thus, as a print is fed into the device 2, the device 2 can process the image bearing surface of a print twice while the print is conveyed through the device 2. Thus, it can prevent the problem that a print is outputted from a thermal finishing device with the presence of gloss imperfections. Also as described above, a gloss imperfection is a phenomenon that an imperfection which occurs to an area of a print, which corresponds in position to an interval between the adjacent two heat generating elements of the thermal head 73. However, the thermal finishing device 2 in this embodiment is structured so that the areas of the image bearing surface of a print which were not heated while the print was conveyed through the upstream surface finishing unit b1 are heated while the print is conveyed through the downstream surface finishing unit b2. Therefore, it is unlikely for the thermal finishing device 2 to output a print suffering from gloss imperfections.

Also as described above, the thermal finishing device in this embodiment is structured so a given heat generating element of its surface finishing second unit b2 is displaced relative to the corresponding heat generating element of its surface finishing first unit b1, in the direction perpendicular to the transfer film movement direction.

<1-5: Comparison Between Thermal Finishing Device in Accordance with Present Invention and Conventional Thermal Finishing Device>

In order to confirm the effects of the present invention upon a thermal finishing device, experiments were carried out to compare the thermal finishing devices in the first and second embodiments of the present invention with two examples of a conventional thermal finishing device. The conditions under which the experiments were carried out, and the results of the experiments, are given next.

Embodiment 1

The thermal finishing device in the first embodiment was provided with two surface finishing units, and was structured so that the two surface finishing units were aligned in the recording medium conveyance direction so that as a print is fed into the device, the image bearing surface of the print is processed twice while the print is conveyed through the device. Further, it was structured so that the thermal head of the downstream surface finishing unit in terms of the print conveyance direction, that is, the thermal head which processes the image bearing surface of a print for the second time, is offset by 85 μm relative to the thermal head of the upstream surface finishing unit, in the direction parallel to the heat generating element alignment direction. The heat element density was 150 dpi.

Embodiment 2

The thermal finishing device in this embodiment was different from the one in the first embodiment in that it has only one surface finishing unit. However, it was provided with a mechanism for conveying a print to the upstream side of the thermal finishing device after the image bearing surface of the print is heated (changed in gloss) for the first time by the device, so that the image bearing surface of the print can be heated (changed in gloss) for the second time. More concretely, after the image bearing surface of a print is processed for the first time, the print is conveyed to the upstream side of the surface finishing unit, and then, the image bearing surface of the print is processed for the second time by the same surface finishing unit. Further, the thermal finishing device was structured so that the thermal head of its surface finishing unit is moved by 85 μm in the heat generating element alignment direction after the image bearing surface of the print is process for the first time, that is, before it is processed for the second time. The heat generating element density was 150 dpi.

(Comparative Thermal Finishing Device 1)

The first comparative thermal finishing device had a single surface finishing unit, and was structured so that it heats (changes in gloss) the image bearing surface of a print only once.

(Comparative Thermal Finishing Device 2)

The second comparative thermal finishing device had two surface finishing units, and was structured so that the image bearing surface of a print is processed (heated) twice. However, the thermal head of its downstream surface finishing unit is the same in position in terms of the heat generating element alignment direction as its upstream surface finishing unit. In other words, in the case of this thermal finishing device, the areas of the surface bearing surface of the print, which are heated by the thermal head of the downstream surface finishing unit are the same as those heated by the thermal head of the upstream surface finishing unit.

In the experiments, the thermal finishing devices in the embodiments of the present invention, and comparative thermal finishing devices, were fed with the same prints, and were evaluated in terms of gloss. The original used for the experiment had gloss test patches, the image density of which ranged from 50% to 100% with an increment of 10%. Before each copy of the original was fed into the thermal finishing devices to be processed for the second time, it was horizontally turned by 90° so that the image bearing surface of the copy was processed from the direction perpendicular to the direction in which it was processed during the first processing of the image bearing surface.

(Conspicuousness of Gloss Imperfections)

The microscopic gloss imperfections of the image bearing surface of each of the processed prints were visually and subjectively evaluated. More specifically, it was determined from the distance of distinct vision, that is, 250 mm, whether or not distinctive difference in gloss can be detected with human eyes between the adjacent two patches on the copy of the original. The distance between the evaluated copies (samples) and a light source was roughly 2-3 m. The angle formed by the line between the light source and copy and the line of sight was adjusted to be in a range of 20°-40°. The following is the standard used for evaluation:

G: no microscopic gloss imperfections were detectable

F: microscopic gloss imperfections were detectable in 10-70% of gradation patches NG: microscopic gloss imperfections were detectable in no less than 70% of gradation patches (Gloss Range)

A term "gloss range" means the range of the gloss which the image bearing surface of a print gains by being processed by the thermal finishing device (unit). That is, if a thermal finishing device said to be "wide in gloss range", it means the device is larger in the number of levels of gloss it can provide the image bearing surface of a print. The gloss range was subjectively evaluated with human eyes. More specifically, it was determined from a distance of 250 mm, or the distance of distinct vision, whether or not there is a distinctive difference in gloss between the adjacent two gradation patches of the copy of the original. The distance between the light source, and a copy (sample) to be evaluated, was roughly 2-3 mm, and the angle formed by the line between the light source and a copy, and the line between the copy and the point of vision, was set to be roughly 20-40°. The evaluation standards are as follow:

G: no gloss imperfections were detectable (gloss difference proportional to input data was detectable between adjacent two gradation patches on copy)

NG: gloss imperfections were detectable (no gloss difference proportional to input data was detectable between adjacent two gradation patches of copy)

The results of the evaluation are given in the following table:

TABLE 1

| | Number of | | Evaluation | |
|---|---|---|---|---|
| | Processing operations | Offset Of Heater | Unevenness Prevention | Variable Range |
| Embodiment 1 | Two | Yes | G | G |
| Embodiment 2 | Two | Yes | G | G |
| Comp. Ex. 1 | One | — | NG | NG |
| Comp. Ex. 2 | Two | No | F | G |

As is evident from Table 1, in the cases of the thermal finishing devices in the first and second embodiments, no gloss imperfections were detected. Further, there was detectable difference in gloss between the adjacent two gradation patches, proving that the thermal finishing devices are capable of providing the image bearing surface of a print with a wide range of gloss. In comparison, in the case of the first comparative thermal finishing device, practically all of the gradation patches of the copy of the original suffered from the gloss imperfections, and also, it was impossible to detect the difference in gloss between the adjacent two gradation patches. These results may be thought to be attributable to the fact that the first comparative thermal finishing device processes (heats) a print only once, and therefore, it fails to fully transfer the surface texture of its transfer film onto the image bearing surface of a print. Further, since it failed to completely transfer the surface texture of its transfer film onto the image bearing surface of a print, it was smaller in the "gloss range". Also in the case of the second comparative thermal finishing device, the gloss imperfections were detectable. However, it successfully provided a wide range of gloss. The second comparative thermal finishing device processes (heats) each print twice, being therefore capable of providing the print a wide range of gloss. However, it cannot heat (process) the areas of the image bearing surface of a print, which correspond in position to the portions of its thermal head, which are between the adjacent two heat generating elements. Thus, it outputs a print suffering from gloss imperfections.

1-5: Effects of Invention

The thermal finishing devices in the preceding embodiments heat the image bearing surface of a print, with the use of a very thin transfer film (no less than 4 μm and no more than 20 μm in thickness) to change the image bearing surface in surface texture (gloss). Thus, it can make its transfer film to virtually perfectly conform to the surface texture of the image bearing surface of a print (sheet P of recording medium), ensuring that the surface texture of the transfer film is accurately transferred onto the image bearing surface of the print. Therefore, it is unlikely to output a print which is imperfect in gloss. Further, the use of a very thin transfer film by a thermal finishing device enables the device to efficiently transfer the heat from its heat generating member to the image bearing surface of a print, and also, to partially heat the image bearing surface to partially change the image bearing surface in gloss. Further, the thermal finishing devices in the preceding embodiments heat the image bearing surface of a print twice. The greater the number of times a print is conveyed through the nip between the platen roller and transfer film of a thermal finishing device to heat the image bearing surface of the print to change the surface in gloss, the better the transfer film of the device conforms to the microscopic peaks and valleys of the image bearing surface of the print, and therefore, the more effectively the device can prevent the problem that as the image bearing surface of a print is heated by a thermal finishing device to change in gloss the image bearing surface of the print, the image bearing surface of the print becomes nonuniform in gloss.

A conventional thermal finishing device fails to thermally process the entirety of the image bearing surface of a print. That is, it fails to heat the areas of the image bearing surface of a print, which correspond in position to the interval between the adjacent two heat generating elements. Thus, it outputs a print which suffers from linear gloss imperfections. In comparison, the surface finishing device in the first embodiment is provided with two heating units, that is, the first and second heating units, and is structured so that the second surface heating unit is displaced in the heat generating element alignment direction by an amount equal to the amount of the interval between the adjacent two heat generating elements. The surface finishing device in the second embodiment is provided with only one surface heating unit, but is structured so that before the image bearing surface of a print is heated for the second times, the thermal head of the unit is displaced in the heating generating element alignment direction by an amount equal to the amount of the interval between the adjacent two heat generating elements of the thermal head. Thus, when the image bearing surface of a print is heated by the surface finishing device in the first embodiment or the one in the second embodiment, the areas of the image bearing surface of the print, which are not processed (heated) while the print was processed for the first time, are processed (heated) while the print is processed (heated) for the second time. Therefore, the surface finishing devices in the first and second embodiments do not output a print which suffers from linear gloss imperfections.

As is evident from the above given detailed description of the print surface finishing devices in the first and second embodiments of the present invention, the present invention can provide a print surface finishing device which can change in gloss a print without making the print imperfect in gloss, that is, nonuniform in gloss and/or insufficient in gloss, and an image forming apparatus having such a print surface finishing device.

Embodiment 2

2-1: General Structure of Print Surface Finishing Device

Figure 6:
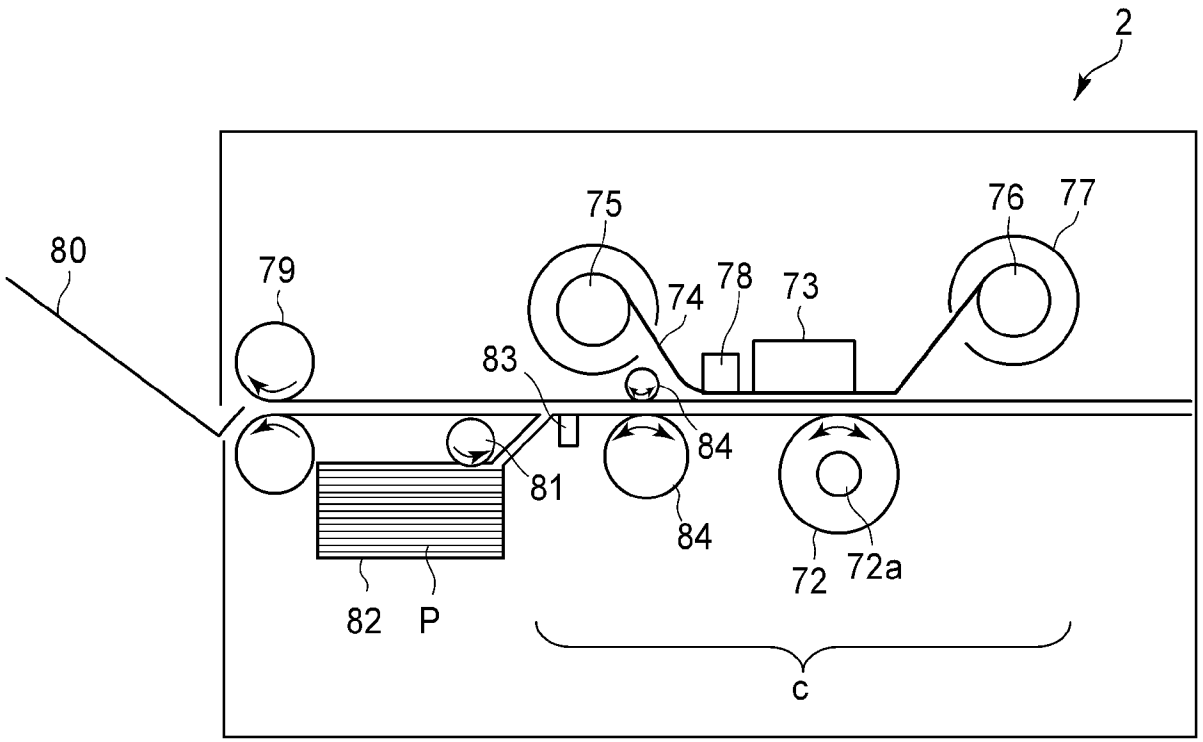
FIG. 6 is a schematic sectional view of the thermal finishing apparatus in the second preferred embodiment of the present invention, and shows the general structure of the apparatus.
Figure 7:
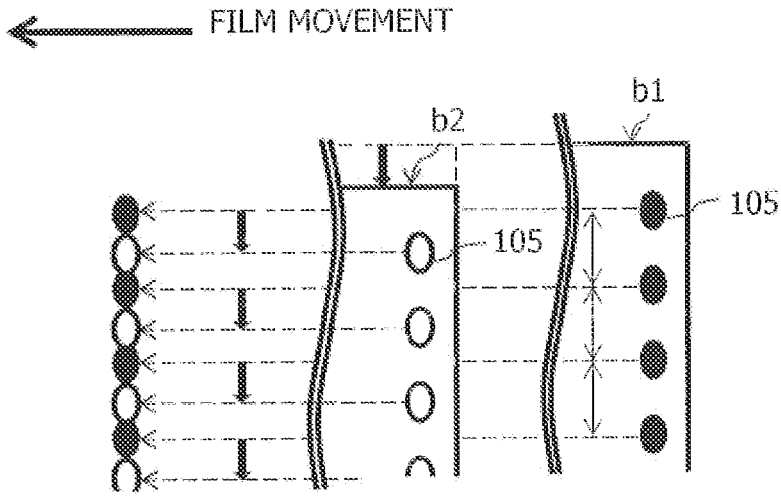
FIG. 7 is a schematic view of the offset of the heat generating elements between the finishing units b1 and b2.

Next, referring to FIG. 6, the print surface finishing device in this embodiment is described. The structural components of this thermal finishing device which are the same in structure and function as those of the thermal finishing device in the first embodiment are given the same referential codes as those given to the counterparts in the first embodiment, and are not going to be described here.

In order to process (heat) the image bearing surface of a print twice, the thermal finishing device in the first embodiment was provided with two surface finishing (heating) units, which are sequentially positioned in the recording medium conveyance direction. In comparison, the surface finishing device in the second embodiment is provided with only a single surface heating unit, but is structured so that as a print is fed into this surface finishing device, the print is heated twice by the surface heating unit of the surface finishing device. Further, the surface finishing device in the second embodiment is provided with a switch-back mechanism, that is, a mechanism for conveying a print back to the entrance of the surface heating unit as the print comes out of the surface heating unit. In other words, this thermal finishing device is structured so that after the image bearing surface of a print is processed (heated) to be changed in gloss for the first time by the surface heating unit of the device, the print is conveyed back to the entrance of the surface heating unit so that the image bearing surface is processed (heated) to be change in gloss for the second time.

More concretely, the surface finishing device 2 in this embodiment has: a recording sheet storage 82 in which sheets P of recording medium are stored; a sheet feeding roller 81 which feeds one by one the sheets P in the recording sheet storage 82, into the main assembly of the device 2; and an edge sensor 83 for detecting the leading and trailing edges of the sheet P as the sheet P is fed into the main assembly. It is also provided with a pair of sheet conveyance rollers 84 which make up the aforementioned switch-back mechanism.

Thus, as one of the sheets P of recording medium is fed into the main assembly of the thermal finishing device 2, the unshown control section calculates the dimension of the sheet P, in terms of the recording medium conveyance direction, based on the results of the edge detection by the edge sensor 83. Then, the print (sheet P) is conveyed by the pair of recording medium conveyance rollers 84 to the nip between the platen roller 72 and transfer film 74, and is conveyed through the nip. While the print (sheet P) is conveyed through the nip, the multiple umber of heat generating elements which are on the heating surface of the thermal head 73 are selectively activated based on the information for the surface finishing (gloss change), print (sheet P) length, and the like information. As a result, the image bearing surface of the print is processed (heated), being thereby changed in gloss, for the first time. The thermal finishing device 2 is structured so that the pair of recording medium conveyance rollers 84 and the platen roller 72 are reversibly rotatable.

After the first processing (heating) of the image bearing surface of a print, the thermal head 73 is moved in the direction parallel to the heating generating element alignment direction (perpendicular to moving direction of transfer film 74) before the image bearing surface of the print is processed (heated) for the second time. The distance by which the thermal 73 is moved as this point in time is equal to the amount of the interval between the adjacent two heat generating elements. For example, if the heat generating element placement density is 150 dpi, the thermal head 73 is moved by 85 μm.

As soon as the thermal head 73 is moved, the image bearing surface of the print is processed (heated) for the second time. More specifically, the pair of recording medium conveyance rollers 84 and the platen roller 72 are rotated in the opposite direction from the direction in which they were rotated during the first processing of the print. Thus, the print is moved in the opposite direction from the direction in which it was moved when its image bearing surface was processed for the first time. During this movement of the print, its image bearing surface is processed (heated) for the second time to be changed in gloss. Then, the print (sheet P) is discharged onto a delivery tray 80 by a pair of discharge rollers 79.

In the case of the print surface finishing device in this embodiment, the print (sheet P), which is to be processed across its image bearing surface, is fed into the main assembly of the device from the print (sheet) storage 82 which is in the bottom portion of the device 2. However, from what a print (sheet P) is fed into the main assembly of the thermal finishing device does not need to be limited to the sheet storage 82 of the device 2. For example, the thermal finishing device 2 may be structured so that a print (sheet P) is fed directly into the device 2 from an image forming apparatus, instead of being fed by away of the sheet storage 82. Further, here, the thermal finishing device 2 in this embodiment was described as a device structured to process (heat) the print (sheet P) twice. However, it may be structured so that a print (sheet P) can be moved through the heating nip of its surface heating unit three or more times to process the print (sheet P) three or more times. In such a case, the thermal head is moved in the opposite direction after the print is processed each time.

As described, the surface finishing device in this embodiment is structured so that after a print (sheet P) is processed (heated) first time, the thermal head of the device, or the print (sheet P) is moved in the direction perpendicular to the direction of the transfer film movement before the print (sheet P) is processed (heated) for the second time.

<Effects of Second Embodiment>

Not only can the second embodiment of the present invention provide the same effects as those provided by the first embodiment of the present invention, but also, it can make it possible to use a single surface heating unit of a print surface finishing device to process (heat) the image bearing surface of a print (sheet P) two or more times to change the image bearing surface in gloss. Thus, the second embodiment makes it possible to provide a print surface finishing device which is significantly smaller than a print surface finishing device equipped with two or more surface heating units to process a print (sheet P) two or more times.

As is evident from the detailed description of the second embodiment of the present invention, the present invention can provide a print (sheet) surface finishing device which does not output a print (sheet) which has gloss imperfections, is nonuniform in overall gloss, and/or suffers from the like defects, and an image forming apparatus having such a print (sheet) surface finishing device.

Miscellaneous Embodiments

In the first embodiment, the thermal head of the downstream surface heating unit in terms of the recording medium conveyance direction is offset in position relative to the upstream thermal head, in the direction parallel to the heat generating element alignment direction by an amount equal to the amount of the interval between the adjacent two heat generating elements. Further, in the second embodiment, after the first processing (heating) of the image bearing surface of a print, the thermal head is moved in the direction parallel to the heat generating element alignment direction, by an amount equal to the amount of the interval between the adjacent two heat generating elements, before the second processing of the print. Because the thermal finishing devices in the first and second embodiments are structured as described above, they can prevent the problem that a print surface finishing device outputs a print, the image bearing surface of which has linear gloss imperfections.

However, the first and second embodiments are not intended to limit the present invention in terms of the structure of a print surface finishing device. For example, the present invention is applicable also to a print surface finishing device structured to shift a print (sheet of recording medium) in the direction perpendicular to the recording medium conveyance direction, instead of shifting its thermal head as the print surface finishing devices in the first and second embodiments do, before it processes (heats) the print for the second time. That is, all that is necessary according the present invention is that the position of the thermal head relative to a print (sheet P) during the second processing (heating) of the print (sheet P) is offset from that during the first processing (heating) of the print (sheet P).

Further, in the first and second embodiments, a print outputted from the image forming apparatus having the image forming station Pe which corresponds to the transparent toner is processed (heated) by the surface finishing device(s) to be changed in gloss. However, these embodiments are not intended to limit the present invention in terms of a print or image to be processed (heated) to be changed in gloss. For example, the present invention is compatible with a print or sheet of recording medium coated entirely by a layer of thermoplastic resin, which can be partially or entirely processed for gloss change by a surface finishing device such as those in the first and second embodiments described above. Further, a print surface finishing device in accordance with the present invention can also process (heat) a print made by an ordinary thermal transfer recording method, a sublimation thermal transfer recording method, an inkjet recording method, or the like, in order to change in gloss the print.

The surface finishing device in this embodiment does not need to be an optional device for an image forming apparatus. That is, it may be an integral part of an image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 280769/2010 filed Dec. 16, 2010, which is hereby incorporated by reference.

What is claimed is:

1. A glossiness processing apparatus for glossiness treatment of an image surface of an image formed on a recording material by applying heat to the image, said glossiness processing apparatus comprising:

a first glossiness treatment unit; and a second glossiness treatment unit provided downstream of said first glossiness treatment unit with respect to a feeding direction of the recording material, wherein each of said first and second glossiness treatment units includes:

a movable film having a surface in contact with an image surface of the recording material while moving;

a heating member contacting another surface of said film, said heating member including a plurality of heat generating elements arranged along a direction substantially perpendicular to a moving direction of said film; and a pressing member cooperating with said heating member to form a nip, with said film therebetween, for nipping and feeding the recording material, wherein the positions of said heat generating elements of said second glossiness treatment unit are offset relative to the positions of said heat generating elements of said first glossiness treatment unit in the direction substantially perpendicular to the moving direction of said film and in the direction substantially perpendicular to the feeding direction of the recording material.

2. An apparatus according to claim 1, wherein said heat generating elements of said first and second glossiness treatment units are actuatable independently from each other.

3. An apparatus according to claim 2, wherein said heat generating elements of said first glossiness treatment unit are selectively made to generate heat in coordination with image information, and said heat generating elements of said second glossiness treatment unit are selectively made to generate heat in coordination with the image information.

4. An apparatus according to claim 3, wherein said heat generating elements of said first and second glossiness treatment units are controlled so that electrical power to be supplied to each heat generating element is changed in pulse width or pulse frequency in coordination with the image information.

5. An apparatus according to claim 3, wherein each of said heat generating elements of said second glossiness treatment unit is displaced in the direction perpendicular to the moving direction of said film, relative to the corresponding heat generating element of said first glossiness treatment unit, by a distance equal to the distance between two adjacent heat generating elements.

6. An apparatus according to claim 3, wherein said heat generating elements of said second glossiness treatment unit are controlled so that the areas of the image on the recording material which were not heated while the recording material was conveyed through the first glossiness treatment unit are heated while the recording material is conveyed through the second glossiness treatment unit.

7. An apparatus according to claim 1, wherein said heat generating elements are formed on a substrate.

8. An apparatus according to claim 1, wherein the thickness of said film is not less than 4 μm and not more than 20 μm.

9. A glossiness processing apparatus for glossiness treatment of an image surface of an image formed on a recording material by applying heat to the image, said glossiness processing apparatus comprising:

a glossiness treatment unit including: a movable film having a surface in contact with an image surface of the recording material while moving; a heating member contacted to another surface of said film, said heating member including a plurality of heat generating elements arranged along a direction substantially perpendicular to a moving direction of said film; and a pressing member cooperating with said heating member to form a nip, with said film therebetween, for nipping and feeding the recording material, wherein said heat generating elements are actuatable independently from each other, and are selectively made to generate heat in coordination with image information, wherein said heat generating elements are controlled so that electrical power to be supplied to each heat generating element is changed in pulse width or pulse frequency in coordination with the image information, wherein said apparatus is operable in a mode in which the recording material having been subjected the glossiness treatment of said nip for the first time is subjected again to the glossiness treatment of said nip for the second time, and wherein after the first glossiness treatment, the heating member or the recording material is moved in the direction perpendicular to moving direction of said film before the second glossiness treatment is processed.

10. An apparatus according to claim 9, wherein the distance by which the heating member or the recording material is moved is equal to the interval between the two adjacent heat generating elements.

11. An apparatus according to claim 9, wherein said heat generating elements are formed on a substrate.

12. An apparatus according to claim 9, wherein the thickness of said film is not less than 4 μm and not more than 20 μm.

13. A glossiness processing apparatus for glossiness treatment of an image surface of an image formed on a recording material by applying a heat to the image, said glossiness processing apparatus comprising:

a glossiness treatment unit including: a movable film having a surface in contact with an image surface of the recording material while moving; a heating member contacting another surface of said film, said heating member including a plurality of heat generating elements arranged along a direction substantially perpendicular to a moving direction of said film; and a pressing member cooperating with said heating member to form a nip, with said film therebetween, for nipping and feeding the recording material, wherein said heat generating elements are actuatable independently from each other, and are selectively made to generate heat in coordination with image information, wherein said apparatus is operable in a mode in which the recording material having been subjected the glossiness treatment of said nip for the first time for the first time is subjected again to the glossiness treatment of said nip for the second time, wherein after the first glossiness treatment, the heating member or the recording material is moved in the direction perpendicular to moving direction of said film before the second glossiness treatment is processed, and wherein the distance by which the heating member or the recording material is moved is equal to the interval between the two adjacent heat generating elements.

14. An apparatus according to claim 13, wherein said heat generating elements are formed on a substrate.

15. An apparatus according to claim 13, wherein the thickness of said film is not less than 4 μm and not more than 20 μm.

* * * * *